US005216398A

United States Patent [19]

Hirota

[11] Patent Number: 5,216,398

[45] Date of Patent: Jun. 1, 1993

[54] MUTUAL LOCKING DEVICE FOR ELECTROMAGNETIC CONTACTORS

[75] Inventor: Takato Hirota, Kanagawa, Japan

[73] Assignee: Fuji Electric Co., Ltd., Kanagawa, Japan

[21] Appl. No.: 818,914

[22] Filed: Jan. 10, 1992

[30] Foreign Application Priority Data

Jan. 17, 1991 [JP] Japan ..... 3-4690[U]

[51] Int. Cl.[5] ..... H01H 9/20

[52] U.S. Cl. ..... 335/160; 200/50 C

[58] Field of Search ..... 335/131-133, 335/160-163, 202; 200/50 C, 50 R

[56] References Cited

U.S. PATENT DOCUMENTS

| | | | |
|---|---|---|---|
| 3,342,958 | 9/1967 | Arneberg et al. . | |
| 3,592,985 | 7/1971 | Arneberg et al. . | |
| 4,513,181 | 4/1985 | Boysen et al. . | |
| 4,544,810 | 10/1985 | Butterworth | 200/50 C |
| 4,659,884 | 4/1987 | Wollenhaupt | 200/50 R |
| 4,689,714 | 8/1987 | Eschermann et al. | 335/161 |
| 4,876,418 | 10/1989 | Fournier | 200/50 C |
| 5,045,647 | 9/1991 | Kato | 200/50 C |

FOREIGN PATENT DOCUMENTS

| | | |
|---|---|---|
| 8808041 | 6/1988 | Fed. Rep. of Germany . |
| WO85/03382 | 8/1985 | World Int. Prop. O. . |

*Primary Examiner*—Lincoln Dononvan

*Attorney, Agent, or Firm*—Finnegan, Henderson, Farabow, Garrett & Dunner

[57] ABSTRACT

A pair of closed contacts having moving contacts (27A), (27B) and fixed contacts (25A), (26A), (25B), (26B) are provided in a mutual locking device (3) and excitation circuits of two electromagnetic contactors which are inversely connected to respective closed contacts to effect electrical interlocking. The moving contacts (27A), (27B) are held by respective levers (36A), (36B) interlocked with driven members (5A), (5B) to be driven by corresponding moving contact supports of the electromagnetic contactors and opened when the electromagnetic contactor closes. Thus, electrical interlocking may be simultaneously effected using a mutual locking device for mechanically preventing two electromagnetic contactors reversibly connected from simultaneously closing.

17 Claims, 5 Drawing Sheets

MUTUAL LOCKING DEVICE FOR ELECTROMAGNETIC CONTACTORS

BACKGROUND OF THE INVENTION

1. Field of the Invention

In general, the present device relates to a mutual locking device for electromagnetic contactors applicable to the forward-to-backward operation of a motor. In particular, the present invention relates to a mutual locking device for use in mechanically interlocking two electromagnetic contactors which are reversibly connected in order to prevent the simultaneous closing of the electromagnetic contactors.

2. Discussion of the Related Art

A mutual locking device of the sort shown in FIGS. 6–8 inclusive, is well known. FIG. 6 shows a transverse sectional view of two electromagnetic contactors in an open state. FIG. 7 shows a transverse sectional view of one electromagnetic contactor in a closed state. FIG. 8 shows an exploded perspective view of the two electromagnetic contactors.

In FIG. 6, there are shown two reversibly-connected electromagnetic contactors 1A, 1B, and moving contact supports 2A, 2B for supporting respective moving contacts, the moving contact supports 2A, 2B being vertically movable. A mutual locking device 3 is used for preventing the simultaneous closing of the electromagnetic contactors 1A, 1B. The device is equipped with a pair of driven members 5A, 5B, a locking pin 6 disposed in a V-shaped cavity 18 formed between tilted edge faces 16A, 16B of driven members 5A, 5B and backing members 10A, 10B.

The driven members 5A, 5B are coupled to the respective moving contact supports 2A, 2B via arms 17A, 17B, and driven to when the electromagnetic contactor 1B is closed. When the driven member 5B descends, the locking pin 6 is pushed to the left by the tilted edge face 16B of the driven member 5B and caused to slide onto the underside of the driven member 5A. As a result, the driven member 5A is prevented by the backing member 10A from descending via the locking pin 6 and the electromagnetic contactor 1A is not allowed to close. While the electromagnetic contactor 1A is in the closed state, the electromagnetic contactor 1B is also not allowed to close. In other words, the mutual locking device 3 operates to prevent the simultaneous closing of the electromagnetic contactors 1A, 1B. However, as shown in FIG. 6, when the locking pin 6 is located at the center the descent of either of the driven members 5A, 5B may be obstructed.

FIG. 9 shows a control circuit in a forward-to-backward operating device for a motor using the electromagnetic contactors 1A, 1B. Electromagnetic coils F, R are connected in parallel via a stop push button switch 21. Opened contacts 22A, 22B, which constitute a closing push button switch, and the closed contacts 24B, 24A of the electromagnetic contactors 1B, 1A are inversely connected in series, respectively. When the excitation circuit of the electromagnetic coil F or R on one side is closed, the excitation circuit of the electromagnetic coil R or F on the other side is opened. These excitation circuits are thus electrically interlocked with each other. There are also provided closed contacts 23A, 23B mechanically interlocked with the opened contacts 22B, 22A of the closing push button switch. move in symmetric cases 4A, 4B while being in contact with each other. The cases 4A, 4B are held with positioning projections 9A, 9B fitted into the respective side walls of the electromagnetic contactors 1A, 1B as shown in FIGS. 6–8. A front and a rear reset spring 7 in combination are used to bias the locking pin 6 upward and press it against the tilted edge faces 16A, 16B so that it is located in the center of the cavity 18.

FIG. 8 is an exploded perspective view of parts constituting the mutual locking device 3 above. Windows 8A, 8B, bored in the cases 4A, 4B, are intended for use in passing the respective arms 17A, 17B of the driven members 5A, 5B. At one end, the reset springs 7 are hooked onto the locking pin 6. At the other end, the reset springs 7 are hooked onto the respective abutting ends of cylindrical projections 11A, 11B incorporated within the cases 4A, 4B. The backing members 10A, 10B are prismatic and integrally formed with the cases 4A, 4B. The cases 4A, 48, incorporating the driven members 5A, 5B, the locking pin 6 and the reset springs 7, are set to face each other and fastened together by means of screws 13 that are forced into screw holes 12B through holes 12A.

With this arrangement, when the electromagnetic contactors 1A, 1B are closed with moving cores (not shown) attracted downwardly as shown in FIG. 7, the moving contact supports 2A, 2B, which are integrally connected with the moving cores, are also caused to move and the driven members 5A, 5B descend correspondingly while guided by the inner wall surfaces of the cases 4A, 4B and the mutual contact surfaces 15A, 15B (FIG. 8). FIG. 7 shows the position to which the driven member 5B descends.

The conventional device described by reference to FIGS. 6–8 has the following shortcomings:

(1) The mutual locking device 3 has no built-in closed contacts. For this reason, with the provision of the electrical interlocking shown in FIG. 9, the mechanical interlocking requires direct use of only the closed contacts of the electromagnetic contactors 1A, 1B which, in turn, results in a shortage of effective closed contacts. Consequently, the number of closed contacts necessary for the intended circuit may become insufficient. In such a case, some measures have to be taken to separately provide additional auxiliary contacts or relays.

(2) Although it has been arranged so that the locking pin 6 is attracted by the reset springs 7 to the tilted edge faces 16A, 16B of the driven members 5A, 5B to ensure that it is held thereon, the reset springs 7 have to be extended to accommodate the locking pin 6 in the cavity 18 when the mutual locking device 3 is fabricated. Assembly thus becomes difficult and time consuming.

SUMMARY OF THE INVENTION

The present invention has been made in view of the above circumstances and has as an object to solve the foregoing problems by providing a mutual locking device for electromagnetic contactors which is capable of simultaneously effecting electrical interlocking without the need for additional circuitry, and which offers easy assembly.

Additional objects and advantages of the invention will be set forth in part in the description which follows and in part will be obvious from the description, or may be learned by practice of the invention. The objects and advantages of the invention may be realized and attained by means of the instrumentalities and combinations particularly pointed out in the appended claims.

To achieve the objects and in accordance with the purpose of the invention, as embodied and broadly described herein, the mutual locking device for electromagnetic contactors, of this invention comprises a housing, a pair of driven members, disposed in the housing, to be driven by corresponding moving contact supports of two electromagnetic contactors which are reversibly connected, the driven members having tilted edge faces at one end so as to form a cavity between the driven members and a backing member which protrudes from the housing towards the ends of the driven members having the tilted edge faces, locking means, disposed in the cavity, for controlling the operations of the driven members so as to prevent the simultaneous closing of the electromagnetic contactors, and a pair of switches, disposed in the housing, each comprising a moving contact connected by a lever interlocked with one of the driven members, and fixed contacts facing the moving contact, wherein the moving contact provides an electrical connection between the fixed contacts when the one of the driven members to which the moving contact is connected is in a position at which the corresponding electromagnetic contactor is open.

BRIEF DESCRIPTION OF THE DRAWINGS

The accompanying drawings, which are incorporated in and constitute a part of this specification illustrate embodiments of the invention and, together with the description, serve to explain the objects, advantages and principles of the invention. In the drawings.

DESCRIPTION OF THE PREFERRED EMBODIMENT

Figure 1:
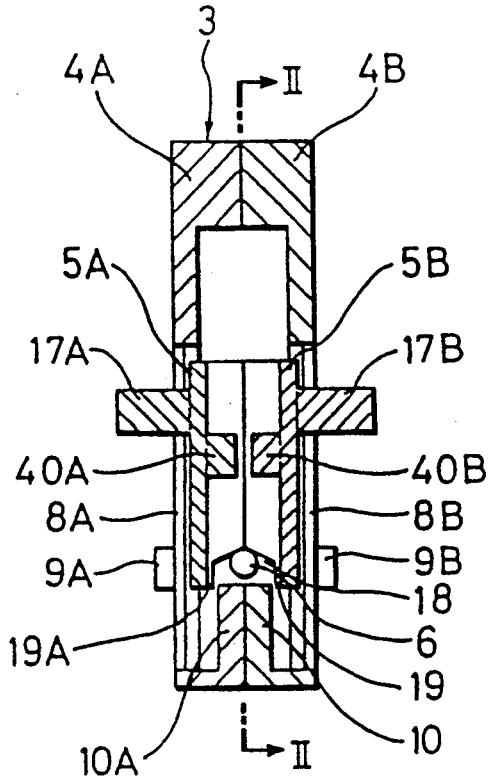
FIG. 1 shows a transverse sectional view of an embodiment of the present device when neither of the electromagnetic contactors remains closed.
Figure 2:
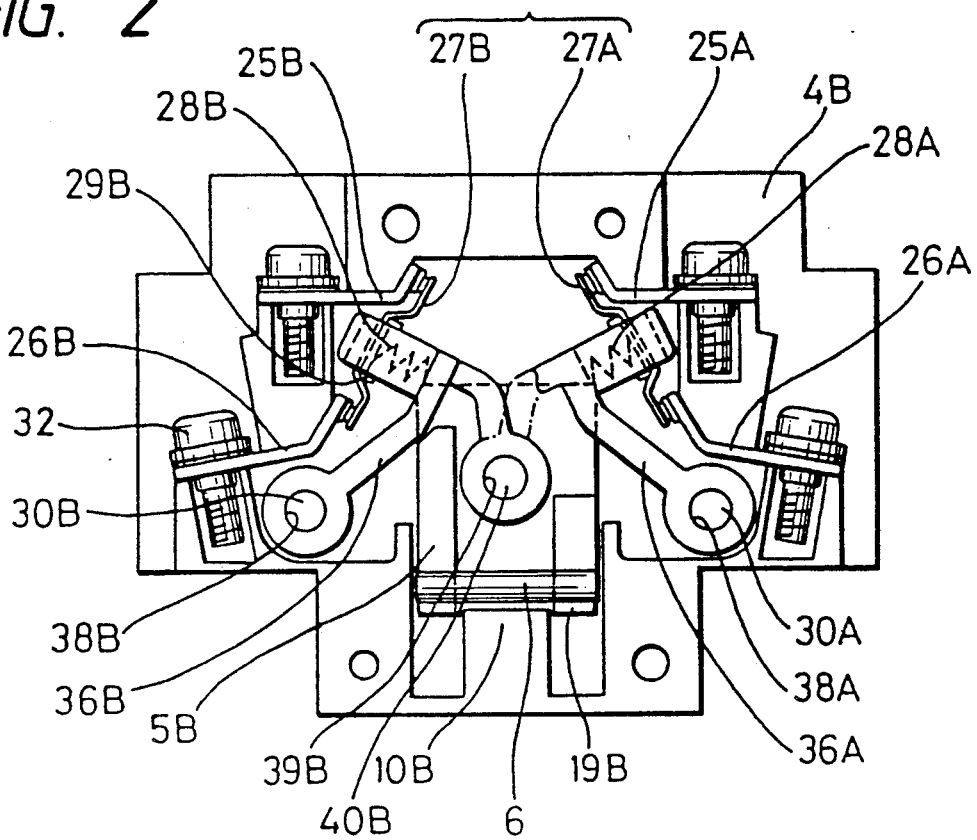
FIG. 2 shows a side view of the interior taken on line II—II of FIG. 1.
Figure 3:
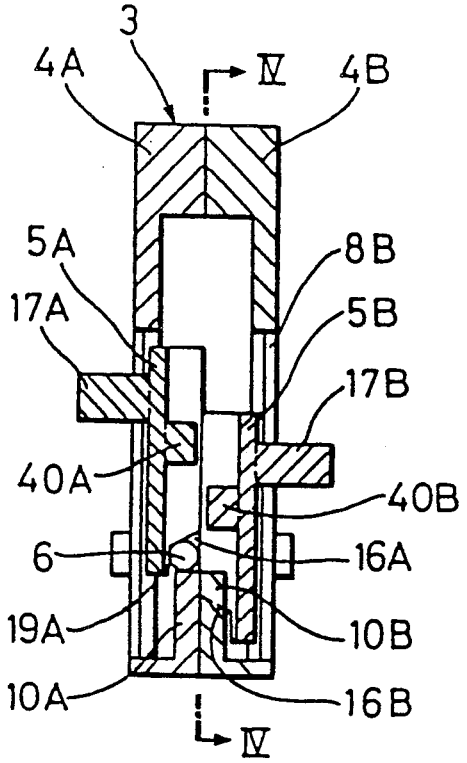
FIG. 3 shows a transverse sectional view of the embodiment of FIG. 1 when one of the electromagnetic contactor closes.
Figure 4:
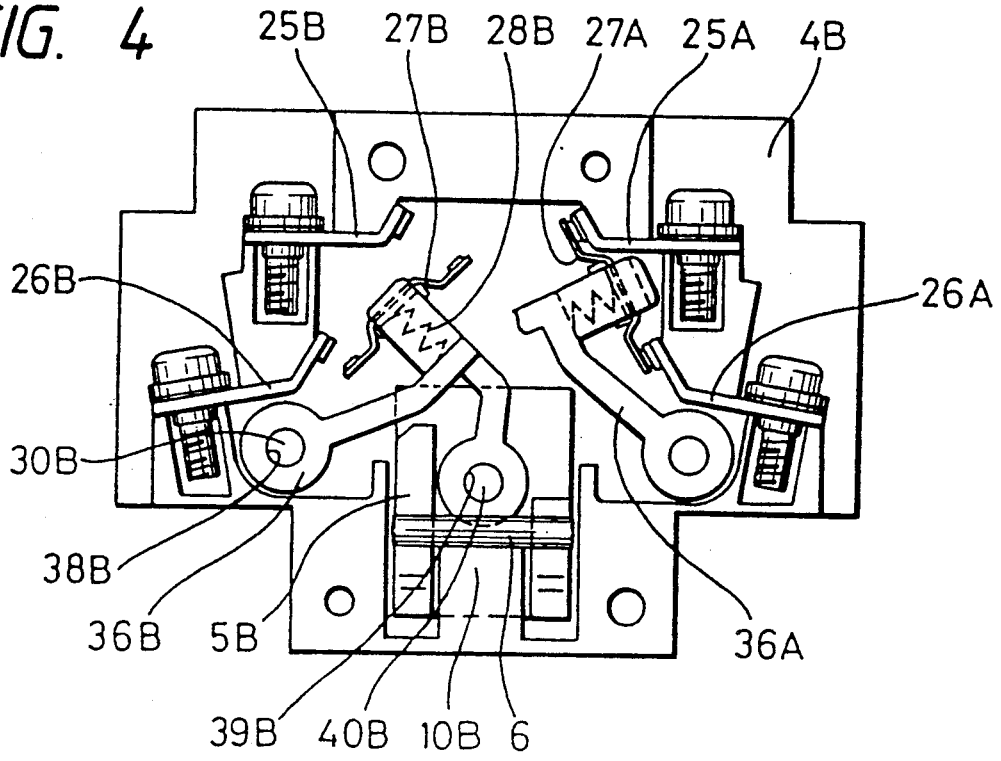
FIG. 4 shows a side view of the interior taken on line IV—IV of FIG. 3.
Figure 5:
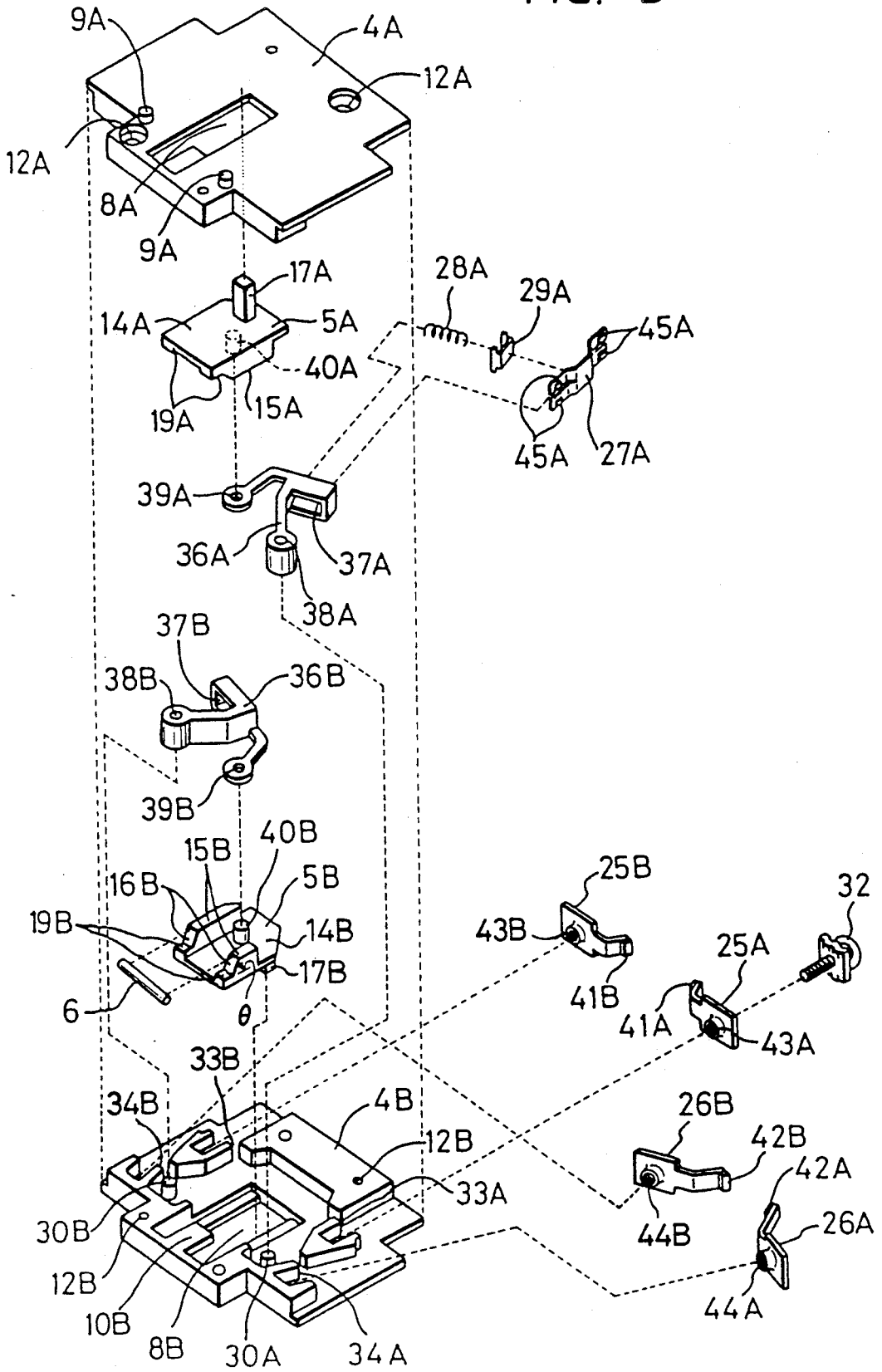
FIG. 5 shows an exploded perspective view of component parts in the embodiment of FIG. 1.
Figure 6:
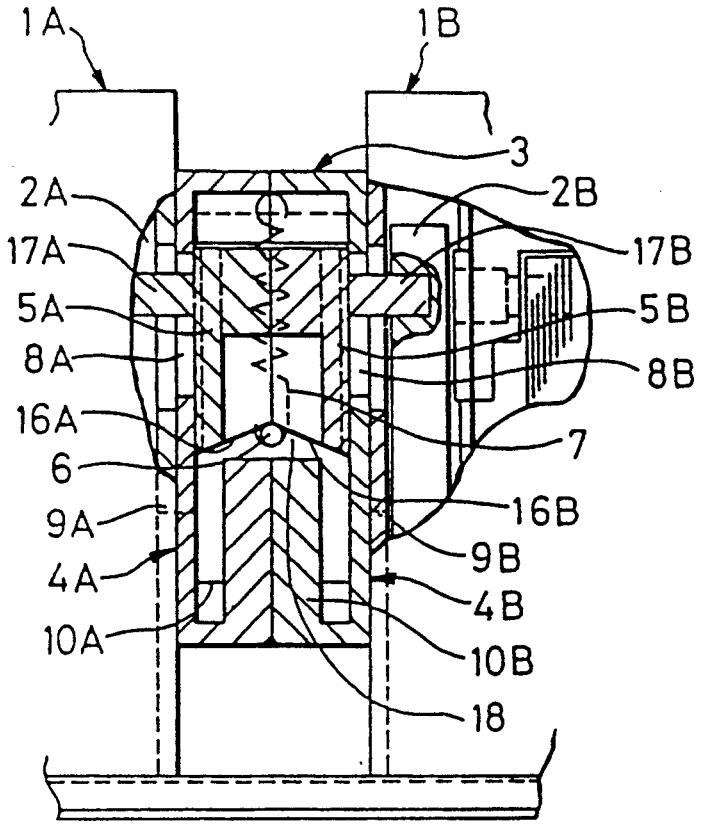
FIG. 6 PRIOR ART
FIG. 6 shows a transverse sectional view of a conventional device when neither of the electromagnetic contactors remains closed.
Figure 7:
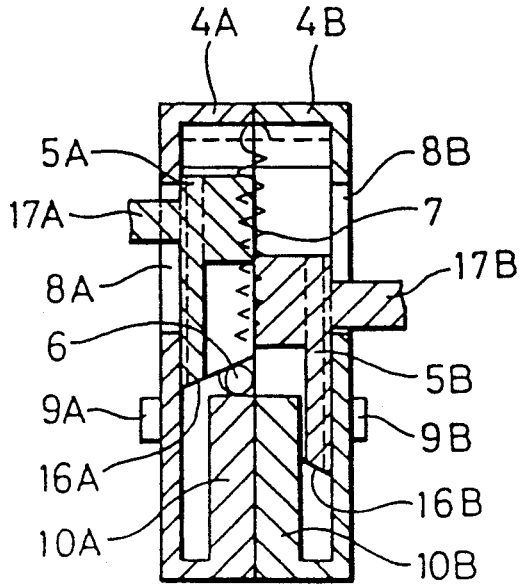
FIG. 7 PRIOR ART
FIG. 7 shows a transverse sectional view of the conventional device of FIG. 4 when one of the electromagnetic contactors closes.
Figure 8:
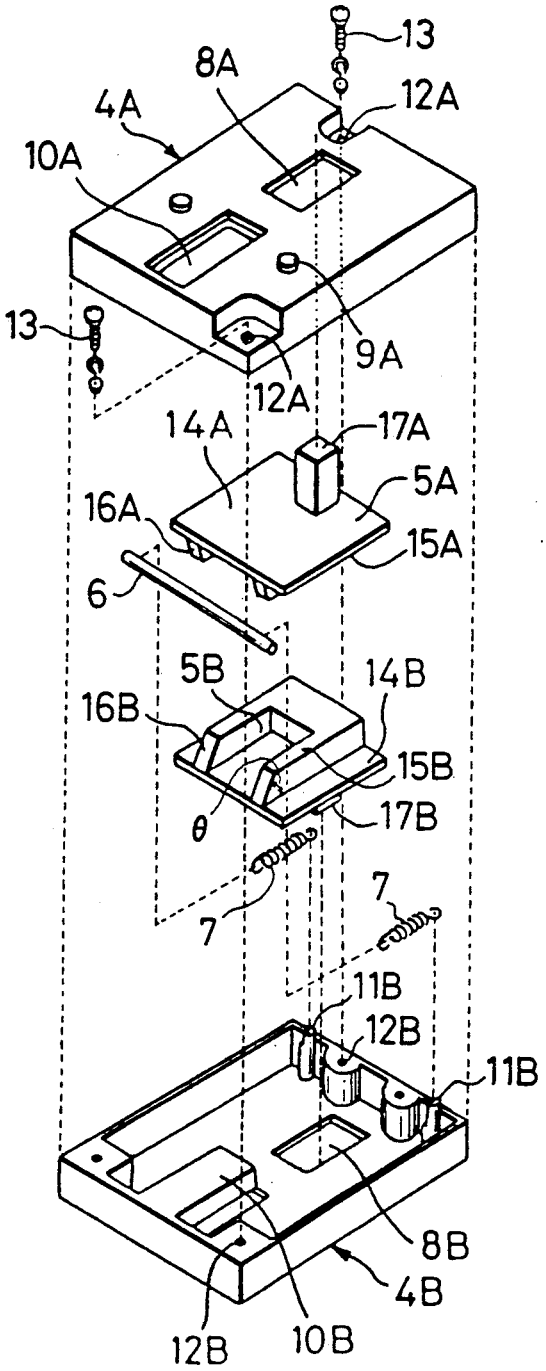
FIG. 8 PRIOR ART
FIG. 8 shows an exploded perspective view of component parts of the conventional device of FIG. 6.
Figure 9:
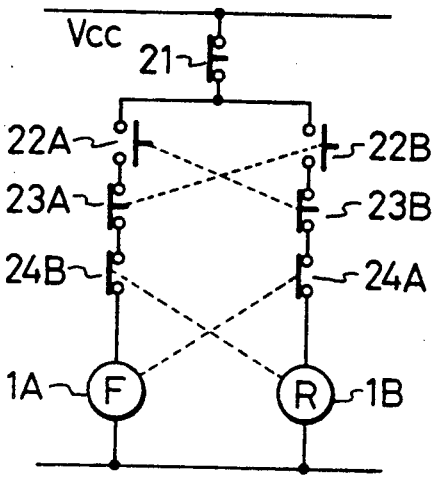
FIG. 9 shows a wiring diagram of the excitation circuit of the electromagnetic contactor explanatory of electrical interlocking.

FIGS. 1-5 of the drawings illustrate an embodiment of the present invention to be described. Like reference characters designate substantially alike parts of the present invention or which correspond to parts of the conventional device in order to simplify the description thereof. FIG. 1 is a transverse sectional view of both electromagnetic contactors which are left open. FIG. 2 is a side view of the interior taken on line II—II of FIG. 1. FIG. 3 is a transverse sectional view of electromagnetic contactors one of which is in a closed state. FIG. 4 is a side view of the interior taken on line IV-IV of FIG. 3. FIG. 5 is an exploded perspective view of the present invention.

As shown in FIGS. 1 and 2, a pair of driven members 5A, 5B, similar to those referred to in the conventional device, are slidably accommodated in respective cases 4A, 4B, and levers 36A, 36B are interlocked with the respective driven members 5A, 5B. As shown in FIG. 2, the levers 36A, 37B are in a trifurcated form with three arms, two of which is pivotally fitted to cylindrical projections 30A, 30B incorporated with the case 4B, and to cylindrical projections 40A, 40B projecting from the driven members 5A, 5B, respectively. Moreover, moving contacts 27A, 27B together with contact springs 28A, 28B are fitted to the respective remaining arms. Fixed contacts 25A, 26A, together with the moving contact 27A, constituting a closed contact, are secured to the case 4B and bridged by the moving contact 27A as shown in FIG. 2 when the corresponding one of the electromagnetic contactors is left open. Similarly, the fixed contacts 25B, 26B, together with the moving contact 27B, constituting a closed contact are also secured to the case 4B.

As shown in FIG. 5, the moving contact 27A and the contact spring 28A are inserted into a window hole 37A of the lever 36A and a spring shoe 29A is inserted between the moving contact 27A and the contact spring 28A. Although not shown, the moving contact 27B is fitted to the lever 36B likewise. Holes 38A, 38B and holes 39A, 39B are those into which the cylindrical projections 30A, 30B and cylindrical projections 40A, 40B are fitted, respectively. The fixed contacts 25A, 26A are forced to enter respective grooves 33A, 34A of the case 4B before being fixed thereto. Likewise, the fixed contacts 25B, 26B are forced to enter respective grooves 33B, 34B of the case 4B before being fixed thereto. Terminal screws 32 are threaded into respective screw holes 43A, 43B, 44A, 44B of the fixed contacts 25A, 25B, 26A, 26B. In this case, moving contacts 45A, 45B and fixed contacts 41A, 41B, 42A, 42B are coupled to the opposing faces of the moving contacts 27A, 27B and the fixed contacts 25A, 25B, 26A, 26B, respectively.

On the other hand, the reset springs 7 in the conventional device, which are attached to the locking pin 6, are not provided in the present invention. Instead, side walls 19A, 19B are provided for enclosing the locking pin 6 in the respective end portions of the driven members 5A, 5B. The locking pin 6 is allowed to move freely in a space between the driven members 5A, 5B and the backing members 10A, 10B. As the locking pin 6 is enclosed within these side walls 19A, 19B, it is prevented from slipping out of the space.

With this arrangement, both electromagnetic contactors 1A, 1B are prevented from closing simultaneously since the descent of the driven members 5A, 5B is obstructed by the backing members 10A, 10B via the locking pin 6. As shown in FIG. 3, the locking pin 6 is pushed by the tilted edge face 16B and caused to slide onto the underside of the driven member 5A when one of the electromagnetic contactors closes, thus making the driven member 5B descend. The other electromagnetic contactor is thus prevented from closing. When one electromagnetic contactor closes, the other one is prevented from closing. As shown in FIG. 4, when one of the electromagnetic contactors is caused to close, thus allowing the driven member 5B to descend, the lever 36B interlocked with driven member 5B pivots about the cylindrical projection 30B and separates the moving contact 27B from the fixed contacts 25B, 26B. Consequently, the insertion of this contact in the excitation circuit of the electromagnetic coil of the other electromagnetic contactor makes it possible to prevent electrical closure of the electromagnetic contactor.

As set forth above, the electrical interlocking is effected without using the closed contact of the electromagnetic contactor, itself, since the mutual locking device 3 has the built-in closed contact which opens when the electromagnetic contactor closes. Moreover, as the driven members 5A, 5B are provided with the respective side walls 19A, 19B, the contact springs 7 in the conventional device can be dispensed with.

According to present device, the mutual locking device itself is able to effect the mechanical and electrical interlocking and a closed contact shortage in the electromagnetic contactor is avoided. As the reset springs can be dispensed with, assembly work is simpler and costs are reduced by a decrease in the number of parts.

The foregoing description of preferred embodiment of the invention has been presented for purposes of illustration and description. It is not intended to be exhaustive or to limit the invention to the precise form disclosed, and modifications and variations are possible in light of the above teachings or may be acquired from practice of the invention. The embodiment was chosen and described in order to explain the principles of the invention and its practical application to enable one skilled in the art to utilize the invention in various embodiments and with various modifications as are suited to the particular use contemplated. It is intended that the scope of the invention be defined by the claims appended hereto, and their equivalents.

What is claimed is:

1. A mutual locking device for electromagnetic contractors, comprising:

a housing;

a pair of driven members, disposed in said housing, to be driven by corresponding moving contact supports of two electromagnetic contractors which are reversibly connected, said driven members having tilted edge faces at one end so as to form a cavity between said driven members and a backing member fixed to said housing and protruding from said housing towards the ends of said driven members having said tilted edge faces;

locking means, disposed in said cavity, for controlling the operations of said driven members so as to prevent the simultaneous closing of said electromagnetic contactors; and a pair of switches, disposed in said housing, each comprising a moving contact connected by a lever interlocked with one of said driven members, and fixed contact facing said moving contact, wherein said moving contact provides an electrical connection between said fixed contacts when said one of said driven members to which said moving contact is connected is in a position at which the corresponding electromagnetic contactor is open.

2. The mutual locking device of claim 1, wherein said locking means comprises a locking pin which is caused to slide between said backing member and one of said driven members to prevent said one of the driven members from being driven by the corresponding electromagnetic contactor when the other one of said driven members is in a position at which the electromagnetic contactor corresponding thereto is closed.

3. The mutual locking device of claim 1, wherein the levers connecting the moving contacts with the driven members are also pivotably connected to said housing.

4. The mutual locking device of claim 1, wherein each lever is a trifurcated lever having a first arm pivotably connected to said housing, a second arm pivotably connected to one of said driven members, and a third arm connected to one of the moving contacts.

5. The mutual locking device of claim 4, wherein said third arm of each trifurcated lever is a slotted arm having said one of the moving contacts slidably disposed therein.

6. The mutual locking device of claim 5, wherein said on of the moving contacts is biased by a spring provided in said slotted arm of said trifurcated lever.

7. The mutual locking device of claim 1, wherein the fixed contacts are fixed to said housing.

8. The mutual locking device of claim 1, wherein said cavity is shaped as a pentagon wherein said backing member constitutes one side thereof, and an end portion of each said pair of driven members constitutes two sides of the pentagonal-shaped cavity.

9. A mutual locking device for electromagnetic contactors, comprising:

a housing;

first shifting means, disposed in said housing, for shifting to one of two positions within said housing in response to corresponding movement of a contact support of a first electromagnetic contactor which is connected thereto;

second shifting means, disposed in said housing, for shifting to one of two positions within said housing in response to corresponding movement of a contact supports of a second electromagnetic contactor which is connected thereto, said first shifting means and said second shifting means having tilted edge faces at one end so as to form a cavity between said first shifting means, said second shifting means, and a backing member fixed to said housing and protruding from said housing towards the end of the first and second shifting means having said tilted edge faces;

locking means, disposed in said cavity, for controlling the operations of the first and second shifting means so as to prevent the simultaneous closing of the first and second electromagnetic contactors; and switching means, disposed in said housing, for electrically disconnecting said first electromagnetic contactor when said second shifting means is shifted in response to a closing of said second electromagnetic contactor, and for electrically disconnecting said second electromagnetic contactor when said first shifting means is shifted in response to a closing of said first electromagnetic contactor.

10. The mutual locking device of claim 9, wherein said switching means comprises a pair of moving contacts connected by levers each interlocked with one of the first and second shifting means, and pairs of fixed contacts facing each moving contact, wherein each moving contact provides an electrical connection between said fixed contacts when one of the first and second shifting means to which said moving contact is connected is in a position at which the corresponding one of the first and second electromagnetic contactors is open.

11. The mutual locking device of claim 9, wherein said locking means comprises a locking pin which is caused to slide between said backing member and said first shifting means to prevent said first shifting means from being shifted by said first electromagnetic contactor when said second shifting means is in a position at which said second electromagnetic contactor is closed, and which is caused to slide between said backing member and said second shifting means to prevent said second shifting means from being shifted by said second electromagnetic contactor when said first shifting means is in a position at which said first electromagnetic contactor is closed.

12. The mutual locking device of claim 9, wherein the levers connecting the moving contacts with the first and second shifting means are also pivotably connected to said housing.

13. The mutual locking device of claim 9, wherein each lever is a trifurcated lever having a first arm pivotably connected to said housing, a second arm pivotably connected to one of the first and second shifting means, and a third arm connected to one of the moving contacts.

14. The mutual locking device of claim 13, wherein said third arm of each trifurcated lever is a slotted arm having said one of the moving contacts slidably disposed therein.

15. The mutual locking device of claim 14, wherein said on of the moving contacts is biased by a spring provided in said slotted arm of said trifurcated lever.

16. The mutual locking device of claim 9, wherein the fixed contacts are fixed to said housing.

17. The mutual locking device of claim 9, wherein said cavity is shaped as a pentagon wherein said backing member constitutes a first side thereof, an end portion of said first shifting means constitutes second and third sides of the pentagonal-shaped cavity, and an end portion of said second shifting means constitutes fourth and fifth sides of the pentagonal-shaped cavity.

* * * * *

UNITED STATES PATENT AND TRADEMARK OFFICE

CERTIFICATE OF CORRECTION

PATENT NO. : 5,216,398

DATED : June 01, 1993

INVENTOR(S) : Takato Hirota

It is certified that error appears in the above-indentified patent and that said Letters Patent is hereby corrected as shown below:

Claim 6, column 6, line 14, change "on" to --one--.

Claim 15, column 8, line 8, change "on" to --one--.

Signed and Sealed this

First Day of February, 1994

Bruce Lehman

*Attest:*

BRUCE LEHMAN

*Attesting Officer*

*Commissioner of Patents and Trademarks*